US008256525B2

(12) United States Patent
Wagner

(10) Patent No.: US 8,256,525 B2
(45) Date of Patent: Sep. 4, 2012

(54) INERTING METHOD FOR REDUCING THE RISK OF FIRE OUTBREAK IN AN ENCLOSED SPACE AND DEVICE THEREFOR

(75) Inventor: Ernst-Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 424 days.

(21) Appl. No.: 12/222,089

(22) Filed: Aug. 1, 2008

(65) Prior Publication Data

US 2009/0038810 A1 Feb. 12, 2009

(30) Foreign Application Priority Data

Aug. 1, 2007 (EP) ..... 07113644

(51) Int. Cl.
*A62C 3/00* (2006.01)

(52) U.S. Cl. ..... 169/45; 169/43; 169/46; 169/5; 169/11

(58) Field of Classification Search ..... 169/45, 169/46, 47, 5, 43, 66, 11, 15, 10
See application file for complete search history.

(56) References Cited

U.S. PATENT DOCUMENTS

| | | | | |
|---|---|---|---|---|
| 4,616,694 | A * | 10/1986 | Hsieh | 165/47 |
| 4,807,706 | A * | 2/1989 | Lambertsen et al. | 169/45 |
| 5,845,714 | A * | 12/1998 | Sundholm | 169/46 |
| 6,560,991 | B1 * | 5/2003 | Kotliar | 62/640 |
| 6,739,399 | B2 * | 5/2004 | Wagner et al. | 169/45 |
| 7,594,545 | B2 * | 9/2009 | Love | 169/45 |
| 7,717,776 | B2 * | 5/2010 | Wagner et al. | 454/369 |
| 2003/0226669 | A1 * | 12/2003 | Wagner | 169/45 |
| 2008/0011492 | A1 * | 1/2008 | Wagner | 169/45 |
| 2008/0047719 | A1 * | 2/2008 | Levander | 169/62 |
| 2008/0078563 | A1 * | 4/2008 | Hock et al. | 169/49 |
| 2008/0135265 | A1 * | 6/2008 | Wagner et al. | 169/45 |

FOREIGN PATENT DOCUMENTS

| | | |
|---|---|---|
| WO | WO 95/02433 | 1/1995 |
| WO | WO 2004/080540 A | 9/2004 |

* cited by examiner

*Primary Examiner* — Len Tran
*Assistant Examiner* — Trevor E McGraw
(74) *Attorney, Agent, or Firm* — Jean C. Edwards; Edwards Neils PLLC

(57) ABSTRACT

The present invention relates to an inerting method for reducing a risk of fire outbreak in an enclosed space as well as a device therefor. A continuous inerting of the enclosed space to spatially-separated zones of the enclosed space is performed as necessary without needing structural separations. At least one inert gas having a gas density ($\rho_{Gas}$) which differs from the mean gas density ($\rho_{Gas}$) of the ambient atmosphere of the space is introduced into the enclosed space such that a gas stratification including a first gas layer (A) and a second gas layer (B) forms in the enclosed space, wherein the oxygen content in the first gas layer (A) corresponds substantially to the oxygen content of the ambient atmosphere, and wherein the oxygen content in the second gas layer (B) corresponds to a specific, definable oxygen content which is lower than the oxygen content of the ambient atmosphere.

44 Claims, 2 Drawing Sheets

INERTING METHOD FOR REDUCING THE RISK OF FIRE OUTBREAK IN AN ENCLOSED SPACE AND DEVICE THEREFOR

CROSS-REFERENCE TO RELATED APPLICATIONS

The present invention claims priority from European Patent Application No. EP 07113644, filed Aug. 1, 2007, the contents of which are herein incorporated by reference in their entirety.

BACKGROUND OF THE INVENTION

1. Field of the Invention

The present invention relates to an inerting method for reducing the risk of an outbreak of fire in an enclosed space as well as a device for realizing the method.

2. Description of the Related Art

Known as a measure to counteract the risk of fire in enclosed spaces in which people only enter occasionally, for example, and in which the equipment therein reacts sensitively to the effects of water, is lowering the oxygen concentration in the respective area to a value of, e.g., about 12% by volume. Most inflammable materials can no longer burn at this oxygen concentration. The main area of application of the present invention hereto are IT areas, electrical switchgear and distributor compartments, enclosed facilities as well as storage areas for high-value commodities.

For example, the specification of German patent application DE 198 11 851 C1 describes an inerting device for reducing the risk of, and extinguishing fires in, enclosed spaces. The known system is thereby designed to reduce the oxygen content in an enclosed space to a predefinable base inertization level and in the event of a fire or when otherwise required, to quickly reduce the oxygen content further to a defined full inertization level so as to enable effective extinguishing of a fire while keeping the storage requirements for inert gas cylinders to a minimum. To this end, the known device includes an inert gas system controllable by a control unit, as well as a supply pipe system connected to the inert gas system and the protected space through which the inert gas provided by the inert gas system is fed into the protected space. Conceivably, the inert gas system would either be a pressure cylinder battery which stores the inert gas in compressed form, a system to produce inert gases, or a combination of both solutions.

The type of system described at the outset concerns a method, and respectively a device, to reduce the risk of, and extinguish fires as needed, in the monitored protected space, whereby continuous inerting of the protected space is likewise used for the purpose of preventing or controlling fires. As stated above, inerting methods function based on the knowledge that under normal conditions, the risk of fire can be countered in enclosed spaces by lowering the oxygen concentration in the respective area to a constant value of, for example, 12% by volume.

The resulting preventative and extinguishing effect of the inerting method is hereby based on the principle of oxygen displacement. As is generally known, normal ambient air consists of 21% oxygen by volume, 78% nitrogen by volume and 1% by volume of other gases. To effectively lower the risk of a fire breaking out in a protected area, the oxygen concentration in the area at issue is reduced by introducing inert gas or an inert gas mixture such as, e.g., nitrogen. An extinguishing effect is known to occur in the case of most solids when the percentage of oxygen falls below about 15% by volume.

Depending on the inflammable materials contained within the protected area, further lowering of the oxygen percentage to, e.g., 12% by volume may be necessary. In other words, this means that by subjecting the protected space to continuous inertization at a so-called "base inertization level" in which the oxygen percentage in the ambient air is reduced to below 15% by volume, the risk of a fire developing in the protected area can also be effectively reduced.

The term "base inertization level" as used herein is to be generally understood as a reduced oxygen content with regard to the ambient atmosphere of the protected space in comparison to the oxygen content of the normal ambient air, whereby from a medical standpoint, however, this reduced oxygen content does not in principle pose any risk whatsoever to persons or animals, so that they—possibly taking certain precautionary measures—can still enter into the protected space.

As indicated above, setting a base inertization level which, in contrast to the so-called "full inertization level," does not necessarily correspond to a reduced oxygen percentage at which effective extinguishing occurs, primarily serves to reduce the risk of a fire from breaking out in the protected space. The base inertization level corresponds to an oxygen content—depending on the circumstances of the individual case—of for example, 13% to 15% by volume.

Conversely, the term "full inertization level" refers to an oxygen content which has been reduced further compared to the oxygen content of the base inertization level and at which the inflammability of most materials is already lowered to the point of no longer being ignitable. Depending on the fire load within the protected space at issue, the oxygen concentration at the full inertization level is normally 11% to 12% by volume.

The solutions known to date which use an inerting method to extinguish fires or to minimize the risk of a fire breaking out in enclosed spaces are designed such that all the goods stored in the enclosed space are incorporated into the fire prevention concept. It is, however, often not necessary to subject the entire volume of the enclosed space to continuous inertization as a preventative measure, since only certain areas of the space may serve to store inflammable materials, for example, while other areas of the space remain unused or store non-combustible materials. Particularly in large warehouses, a continuous inertization of the entire stockroom volume would only make economic sense when the entire volume of the space is actually used to store combustible materials.

Since particularly the consumer goods and foodstuff industries are intimately geared to consumer behavior and changes in consumer behavior have a direct impact on the market, it is desirable for the retail market to be able to react as flexibly as possible to any restructuring of storage or transportation conditions. Warehouses able to particularly easily adapt their storage capacity and storage conditions to the respective market situation are therefore in demand. The same holds equally true for inerting systems frequently used in such warehouses as preventative protection against fire.

SUMMARY OF THE INVENTION

The present invention is thus, based on the task of specifying an inerting system (method and device) for an enclosed space which on the one hand achieves an effective lessening of the risk of incipient fire by means of a continuous inerting of the protected space and, on the other, the preventative fire protection effected by this continuous inertization can be limited to spatially-separated zones of the enclosed space as necessary without needing structural separations to do so.

This task is solved in accordance with the invention by an inerting method of the type cited at the outset which introduces into the enclosed space an inert gas or an inert gas mixture having a gas density which differs from the mean gas density of the ambient atmosphere of the enclosed space such that a stratification of gas consisting of a first gas layer, a second gas layer and a transition layer situated between said first and second gas layer forms in the enclosed space without structural separation, whereby the oxygen content in the first gas layer corresponds substantially to the oxygen content of the ambient atmosphere, and whereby the oxygen content in the second gas layer corresponds to a specific, definable oxygen content which is lower than the oxygen content of the ambient atmosphere.

With respect to the present invention, the device includes an inerting system for reducing the risk of a fire developing in an enclosed space, whereby it is inventively provided for the inerting system to include at least one inert gas source for supplying an inert gas or an inert gas mixture, and a supply, and outlet nozzle system controllable by a control unit, for introducing the inert gas or inert gas mixture supplied by the inert gas source, into the ambient atmosphere of the enclosed space. The inert gas or inert gas mixture exhibits a gas density differing from the mean gas density of the ambient atmosphere of the enclosed space, and the inert gas or inert gas mixture can be introduced into the enclosed space by means of the supply and outlet nozzle system in regulated manner such that a gas stratification, including a first gas layer, a second gas layer and a transition layer situated between the first and second gas layer, forms in the enclosed space without structural separation.

The device according to the invention thus concerns one embodiment of the inventive inerting method. In this embodiment, the oxygen content in the zone of the first gas layer corresponds substantially to the oxygen content of the ambient atmosphere. On the other hand, the oxygen content in the zone of the second gas layer corresponds to a specific, definable oxygen content which is lower than the oxygen content of the ambient atmosphere.

There are many advantages attainable with the inventive solution. Products or goods to be stored can accordingly be accommodated in specific zones of the enclosed space without any spatial separation and without requiring complex measures to isolate them from one another so that said stored goods are always readily available, whereby the oxygen content of the zones within the enclosed space can be individually adapted to the fire and combustion properties of the goods stored within them. For example, goods susceptible to fire or highly flammable would be accommodated in the second gas layer zone in which a reduced oxygen content is set relative to the ambient atmosphere, while goods of low flammability or non-combustible goods could be stored in the first gas layer zone. On the other hand, it is of course also conceivable to only store goods in the zone of the enclosed space in which the second gas layer is formed while keeping the zone of the first gas layer empty of goods. This would for example, make sense when all the goods to be stored in the enclosed space are combustible or highly flammable, however these goods to be stored do not fully exhaust the storage capacity of the enclosed space.

The oxygen content in the first gas layer zone corresponds to the oxygen content of the ambient atmosphere. Thus, the oxygen content in the first gas layer is at roughly 21% by volume when the ambient atmosphere at the time the gas stratification forms in the enclosed space has an oxygen content corresponding to the oxygen content of ambient air (i.e., approx. 21% by volume). Having said that, it is of course conceivable that the enclosed space is already being continuously rendered inert at a base inertization level at the time the gas stratification forms. For example, when a base inertization level at an oxygen content of for example, 15% by volume, is already set in the enclosed space prior to formation of the gas stratification, the zone containing the first gas layer will also have an oxygen content of 15% by volume after said gas stratification having formed.

To understand the term "inert gas" as used herein, are all applicable gases which are chemically inert and which exhibit an extinguishing effect based on oxygen displacement. The stifling effect attainable with inert gases occurs upon falling below the specific, material-dependent critical limit required for combustion. As already stated above, most fires are extinguished when the oxygen content falls even just to 13.8% by volume. Therefore, only about ⅓ of the volume in the second gas layer of ambient atmosphere has to be displaced by introduced inert gas, which corresponds to an inert gas concentration of 34% by volume. Incendiary agents which need considerably less oxygen to ignite, require a correspondingly higher inert gas concentration, as is the case with acetylene, carbon monoxide or hydrogen, for example. Argon, nitrogen, carbon dioxide or mixtures thereof (i.e., Inergen, Argonite) are specifically conceivable as inert gas extinguishing agents in accordance with the present invention.

Moreover, the term "gas density" as used in the present specification refers to the definable density of a gas in accordance with the ideal gas law. According to the term, the gas density $\rho_{Gas}$ has the following relationship:

$$\rho_{Gas} = \frac{p \cdot M}{R_m \cdot T}, \qquad \text{Equation 1}$$

wherein $\rho_{Gas}$ is the gas density in kg/m$^3$, p is the absolute pressure on the gas in kPa, M is the molar mass of the substance in g/mol, $R_m$ is the universal gas constant (=8.134 J/mol/K), and T the absolute temperature in K°.

Table 1 below contains a sample listing of the respective $\rho_{Gas}$ gas densities for different inert gases which could for example, be employed in the solution according to the invention in their pure forms or as a mixture. The data in the table is based on normal conditions; i.e., a pressure p of 1013.25 hPa (=1.01325 bar) and a temperature T of 273.15 K°(=0° C.).

TABLE 1

| Inert gas | Density [kg/m$^3$] | Symbol |
|---|---|---|
| Helium | 0.178 | He |
| Nitrogen | 1.251 | $N_2$ |
| Argon | 1.784 | Ar |
| Carbon dioxide | 1.977 | $CO_2$ |
| Krypton | 3.479 | Kr |
| Xenon | 5.897 | Xe |
| Air at 0° C. | 1.292 | |

It is clear that the present inventive solution can effectively reduce the operating costs coupled with providing preventative fire protection, and thus, the logistics costs for a warehouser, since it is no longer necessary for a preventative measure to effect continuous inerting of the entire volume of the space with an inert gas or an inert gas mixture. Instead, without needing to provide for structural measures, different spatially-separated zones of predefinable oxygen content, inertization levels respectively, can be formed within the volume of the space. This can yield considerable warehousing advantages, since both fire-sensitive products as well as non-fire-sensitive products can be accommodated in one warehouse (enclosed space) without spatial separation and without needing complex measures to segregate them.

The basic idea underlying the solution according to the invention is to be seen in the physical layering of gases of different specific densities. Such gas stratifications are relatively stable and, in the ideal case, in particular when there is no airflow or air circulation within the enclosed space, are mainly only affected by the diffusion flow to the gas particles in the two gas layers. Taking the appropriate measures, which will be addressed in greater detail below, will achieve the corresponding compensation for the diffusion coefficients of the respective gas particles so as to maintain the gas stratification established in the enclosed space over a longer period of time.

The transition layer, meaning that zone which is situated between the first and the second gas layer, is the boundary layer provided between the two gas layers of relatively small thickness in relation to the thickness of the first and the second gas layer. The transition layer contains a mixture of the gas particles present in the two gas layers, whereby this mixture is primarily contingent upon the diffusion flow to the gas particles.

With respect to continuously maintaining the storage zones formed in the enclosed space by the two gas layers of the gas stratification formed in the enclosed space, it is thus, advantageously provided for the regulated feeding of inert gas or an inert gas mixture into the second gas layer, as well as the appropriate extracting of gas from the second gas layer and/or from the transition layer. Thus, this is a measure which effectively compensates for the counteractive diffusion flow on the gas stratification.

Due to the principles of the Boltzmann distribution law which is known to govern gas dynamics, according to which, due to the internal energy of the gas particles (entropy), both the diffusion to the gas particles in the first gas layer, as well as the diffusion to the gas particles in the second gas layer, can have a countering effect on the gas stratification in the enclosed space, it is necessary to extract gas preferably from the transition layer either continuously, or at preset times or upon preset events, whereby inert gas or an inert gas mixture is simultaneously fed to one of the two gas layers, for example, the second gas layer, in regulated manner. By extracting gas from the transition layer, particularly the inert gas portion diffused into the transition layer from the second gas layer, it is at least partly dissipated so as to effect the most systematic separation as possible between the first and the second gas layer. In the process, particularly also the thickness of the transition zone is kept to a low value.

On the other hand, at the same time gas is extracted from the transition layer, a sufficient amount of inert gas is introduced into the second gas layer in a regulated manner so as to have the oxygen content in the zone of the second gas layer always exhibit the specific reduced oxygen content relative to the oxygen content of the ambient atmosphere, and the oxygen content of the first gas layer respectively. In particular, this measure maintains the spatial separation of the gas layers forming the gas stratification in a particularly effective and yet easily realized manner.

One particularly preferred embodiment according to the invention provides for, after the gas stratification forming in the enclosed space on the one hand in the zone of the first gas layer and, on the other, in the zone of the second gas layer, determining the temperature in each case either continuously or at predefined times or upon predefined events, whereby the determined temperature values of the zones of the first and the second gas layer are used to set and maintain a specific temperature difference between the zone of the first gas layer and the zone of the second gas layer. This advantageous further development accordingly enables both zones (layers) of differing oxygen contents as well as zones (layers) of differing temperatures to be formed and maintained in the enclosed space without needing to use any structural partitions or the like. It is hereby particularly preferred for the lower layer of the two gas layers to exhibit a temperature which is lower than that of the upper layer of the two gas layers so as to achieve a thermal stratification which is known to be extremely stable.

Since in this preferred further development, the upper gas layer zone, preferably the second gas layer zone, exhibits a higher temperature than the lower gas layer zone, preferably the first gas layer zone, the thermal stratification will further support the maintaining of the gas stratification formed in the enclosed space. It is hereby pointed out that the $\rho_{Gas}$ gas density of the inert gas, the inert gas mixture respectively, pursuant to the above equation 1, is inversely proportional to the temperature T, so that when the second gas layer zone exhibits a higher temperature than the first gas layer zone, there is a greater difference in density $\square\rho_{Gas}$ between the inert gas used to form the second gas layer and the gas constituting the ambient atmosphere.

The temperature measurement addressed in the above further development ensues in a known manner, whereby of particular advantage, is measuring the respective temperature values at different positions within the enclosed space, the respective zones of the gas layers formed in the enclosed space respectively, so as to enable the most exact and in particular redundant temperature measurement as possible.

Technically realizing the setting and maintaining of the cited temperature difference between the first and the second gas layer can likewise be effected in different ways. Particularly conceivable would be to pre-heat or pre-cool the inert gas or inert gas mixture introduced to form the gas stratification in the enclosed space accordingly, so as to set a temperature in the zone including the second gas layer which is higher or lower than the mean temperature in the zone of the first gas layer. On the other hand, however, it would also be conceivable to set and maintain the difference in temperature using corresponding heating/cooling elements disposed at suitable positions within the zones of the respective gas layers. However, other solutions are particularly just as conceivable here.

In order to be able to reliably sustain the preventative fire protection measures provided by the inventive solution for longer periods of time, one advantageous further development provides for measuring the oxygen content in the second gas layer zone continuously or at predefined times or upon predefined events, and keeping the oxygen content in the second gas layer zone at the predefinable inertization level corresponding to a reduced oxygen content relative to the oxygen content of the first gas layer zone by the regulated feeding of inert gas or an inert gas mixture into the second gas layer zone, as well as by the regulated extracting of gas from the second gas layer zone and/or from the transition layer. Thus, it is achievable that a continuous inertization can be set and maintained in the enclosed space in the zone including the second gas layer, which—depending on the goods stored in the second gas layer zone, their combustibility and their ignition behavior, respectively—ensures effective protection against fire. It is clear that the predefinable and reduced oxygen content to the second gas layer zone relative to the oxygen content of the first gas layer zone can be accordingly adapted to the combustibility or ignition properties of the goods stored or to be stored in said zone.

Measuring the oxygen content in the second gas layer zone is effected in the customary way, whereby particularly well-suited to the task is an aspirative system which preferably actively extracts a representative sample of the atmosphere of the second gas layer from a plurality of locations within the zone of the second gas layer through a pipeline or channel system, and then feeds the samples to a measuring chamber including a detector to measure the oxygen content. Of course, other solutions can also be considered here.

With respect to the inert gas or inert gas mixture used in the solution according to the invention, it is particularly preferred for this inert gas or inert gas mixture to exhibit a specific gas density $\rho_{Gas}$ which differs from the specific gas density $\rho_{Gas}$ of the ambient atmosphere at the same temperature. As already indicated by the examples in the above Table 1, various different inert gases can be considered here. Particularly conceivable as the inert gas would be argon, carbon dioxide or krypton or xenon, or mixtures thereof; i.e., gases having a higher gas density $\rho_{Gas}$ than the gas density of "normal" air or higher respectively than the gas density of the ambient atmosphere of the enclosed space when the ambient atmosphere at the time the gas stratification forms in the enclosed space exhibits a chemical composition which corresponds to the chemical composition of normal ambient air.

When the temperature of the second gas layer zone; i.e., in which the inert gas is introduced so as to form the gas stratification, is lower than the temperature of the first gas layer zone; i.e., lower than the temperature of the ambient atmosphere, a particularly well-pronounced and stable stratification forms in the enclosed space with the second gas layer zone below the first gas layer zone.

On the other hand, it would of course also be conceivable to use for example, nitrogen or helium or a mixture thereof as the inert gas; i.e., a gas having a mean gas density lower than the gas density of air. In so doing, particularly with the nitrogen inert gas, it is expedient prior to introducing the inert gas into the space, and into the zone of the second gas layer respectively, to heat this inert gas accordingly so as to further lower its specific gas density, which allows a gas stratification to be realized in the enclosed space in which the second gas layer situates above the first gas layer.

In order to be able to store goods of differing ignition properties in the enclosed space, one further advantageous development provides for establishing continuous inertization not only in the zone of the enclosed space in which the second gas layer is formed, but also in the zone of the space in which the first gas layer is formed. Specifically conceivable in this development is changing the ambient atmosphere of the enclosed space prior to forming the gas stratification in the enclosed space by introducing an inert gas or an inert gas mixture, such that the oxygen content in the ambient atmosphere is lowered to a specific base inertization level which corresponds to a reduced oxygen content compared to the normal air oxygen content (approx. 21% by volume). What this method—which is effected prior to the gas stratification forming in the enclosed space—achieves, is that two zones of differing oxygen content which are spatially separated from one another, form in the enclosed space subsequent to the gas stratification, whereby the respective oxygen content of these two zones, and gas layers respectively, is reduced compared to the oxygen content of the normal ambient air. By appropriately selecting the base inertization level, which is set prior to the gas stratification being formed in the enclosed space, and by appropriately selecting the specific oxygen content set for the second gas layer when forming the gas stratification, it is thus, possible to set the respective oxygen content in the two gas layers including the gas stratification, to an inertization level which is adapted to the goods to be stored in the respective zones.

One further development, of especially the latter-cited embodiment, preferably provides for the oxygen content in the first gas layer to be measured continuously or at predefined times and that the oxygen content in the first gas layer is maintained at the base inertization level by the regulated feeding of inert gas or an inert gas mixture into the first gas layer as well as the regulated extraction of gas from the first gas layer and/or from the transition layer. This is a measure well-suited to ensure that the stratification formed will not be dissipated over time by the diffusion flow to the individual gas particles.

To have the inventive solution not only be applicable as a preventive measure to protect against fires but also as a measure to control fires, another further development provides for at least one fire characteristic to be measured, preferably in the second gas layer, continuously or at predefined times or upon predefined events, whereby when at least one fire characteristic or a respective fire is detected, the oxygen content in the second gas layer or in the entire spatial volume is lowered by means of the sudden introduction of inert gas, preferably into the zone of the second gas layer, to a full inertization level which corresponds to a further reduced oxygen level compared to the defined inertization level, and at which the inflammability of the goods stored in the second gas layer zone can be effectively suppressed, respectively, at which a fire can be effectively extinguished. Additionally or alternatively to the full inertization level being set in the event of a fire, it is of course also conceivable for a chemical extinguishing gas to be introduced into the space which has an extinguishing effect based on an action other than a suffocative one. A conceivable chemical extinguishing gas might for example be HFC-227ea or Novece®1230 or a mixture thereof.

The term "fire characteristic" as used herein is to be understood as a physical variable which is subject to measurable changes in the proximity of an incipient fire, e.g., ambient temperature, solid, liquid or gaseous content in the ambient air (accumulation of smoke particles, particulate matter or gases) or the ambient radiation.

The fire characteristic is preferably detected with an aspirative suction pipe system which actively extracts representative samples of the atmosphere of, for example, the second gas layer and then feeds the samples to a measuring chamber which includes a detector used to detect a fire characteristic. Of course, other measures would also be applicable here.

Alternatively or additionally to the previously-cited embodiment, it is further conceivable to measure at least one fire characteristic in the first gas layer zone on a continuous basis or at preset times or upon preset events, whereby when a fire characteristic is detected, the oxygen content in the first gas layer is lowered by means of the sudden introduction of inert gas or an inert gas mixture into the zone of the first gas layer, to an inerting level which corresponds to a reduced oxygen content compared to the oxygen content of the ambient atmosphere and at which the inflammability of the goods stored in the zone formed by the first gas layer is effectively suppressed.

Lastly, it is also advantageous with respect to the inventive method to be able to regulate the respective layer thicknesses; i.e., the thickness of the first gas layer zone and the thickness of the second gas layer zone. This further development enables a particularly fast and easily-realized expandability to the fire-resistant zones in the space by allowing a flexible formation of the respective gas layers within the warehousing dimensions.

When technically realizing the inventive solution in a device, it is preferred for the outlet nozzle system to include at least one vertically-displaceable outlet nozzle such that the vertical position or location of the second gas layer, and thus, also the position or location of the first gas layer, can be adjustable within the enclosed space.

It is also preferable for the device of the inerting method to further include a suction system controllable by a control unit to extract gas from the second gas layer, and/or in particular from the transition layer, in a regulated manner while simultaneously feeding inert gas into the second gas layer zone through the outlet nozzle system, whereby the oxygen content in the second gas layer zone is maintained at the inertization level corresponding to the defined oxygen content.

BRIEF DESCRIPTION OF THE DRAWINGS

Reference will be made in the following to the attached drawings in describing preferred embodiments of the inerting system according to the present invention. Shown are.

DESCRIPTION OF THE INVENTION

Figure 1:
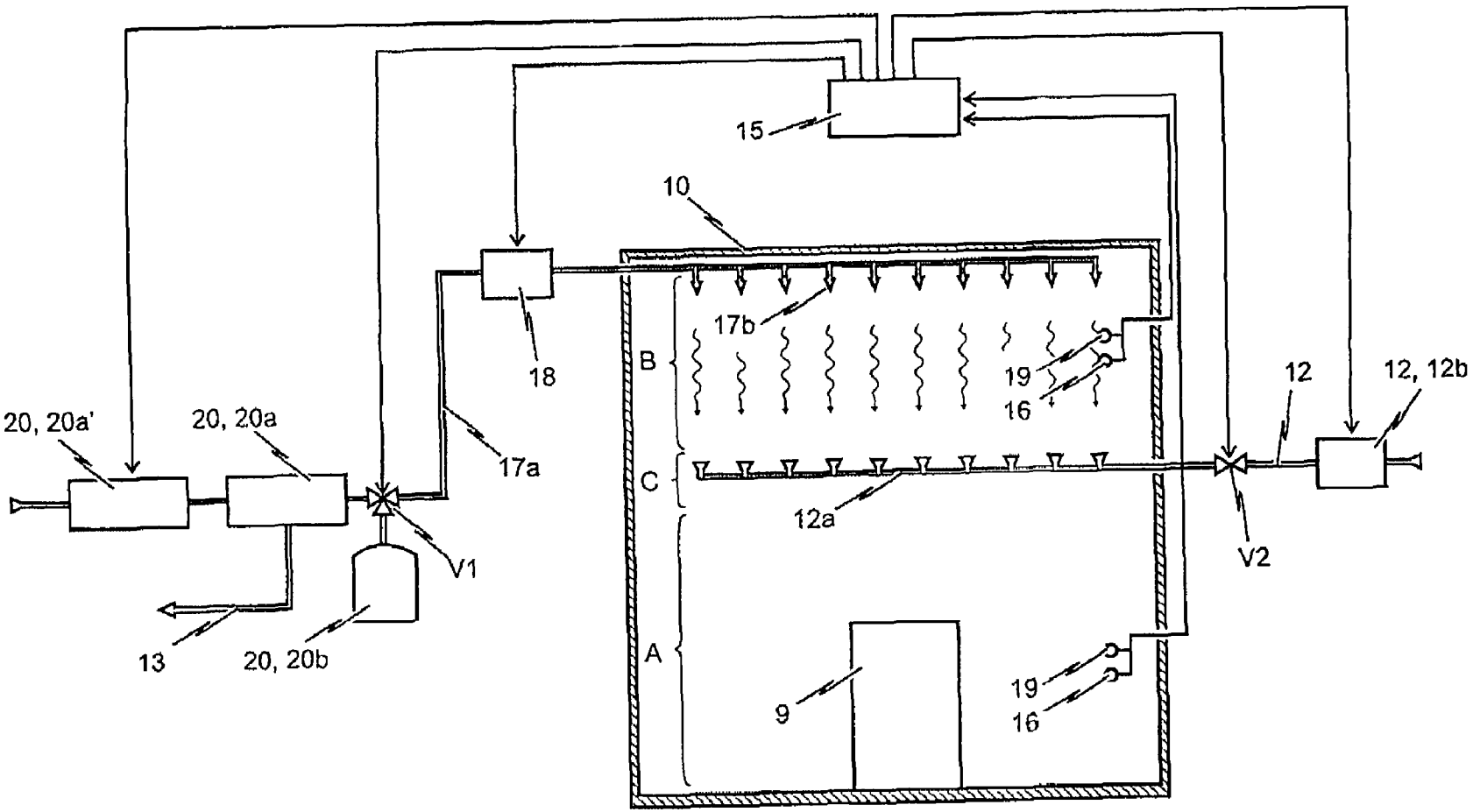
FIG. 1 is a first embodiment of the inerting system according to the invention.

FIG. 1 depicts one embodiment of the inventive inerting system for reducing the risk of a fire in an enclosed space 10, whereby this system is particularly suited to realizing the inerting method according to the invention.

The system depicted schematically in FIG. 1 includes an inert gas source 20 to supply an inert gas or an inert gas mixture which includes, for example, an inert gas generator 20*a*, in particular, a nitrogen generator and a gas cylinder battery 20*b* in which inert gas or an inert gas mixture is stored under high pressure. An ambient air compressor 20*a*' is connected to the inert gas generator 20*a*. A control unit 15 accordingly regulates the air supply rate of the ambient air compressor 20*a*'. This allows the control unit 15 to set the rate of the inert gas supplied by the inert gas system 20*a*, 20*a*'.

The inert gas produced by the inert gas system 20*a*, 20*a*' and/or the inert gas supplied by the gas cylinder battery 20*b* is fed to the monitored space 10 through the supply pipe system 17*a*. Of course a plurality of additional protected spaces can also be connected to supply pipe system 17*a*. Specifically, the inert gas provided by the inert gas source 20 is supplied to the space 10 through outlet nozzles 17*b* arranged at appropriate locations within space 10.

The embodiment as depicted includes having the inert gas, advantageously nitrogen, being extracted locally from the ambient air. The inert gas generator, nitrogen generator 20*a*, respectively, functions for example, according to membrane or PSA technology known in the prior art, in order to produce nitrogen-enriched air of, for example, 90% to 95% nitrogen by volume. This nitrogen-enriched air serves as the inert gas which is fed to space 10 through the supply pipe system 17*a*. The oxygen-enriched air resulting from the inert gas production is discharged to the outside through a further pipe system 13.

As indicated above, the inert gas source 20 is connected to enclosed space 10 by the supply pipe system 17*a* and the outlet nozzle system 17*b*. The outlet nozzle system 17*b* preferably includes a plurality of outlet nozzles which are distributed in a horizontal plane within the interior of space 10 in the embodiment as depicted. The regulated supply of the inert gas provided by the inert gas source 20 into the ambient atmosphere of enclosed space 10, ensues by suitably controlling a control valve V1 in the supply pipe system 17*a*. Specifically, the control valve V1 is correspondingly controllable by the above-mentioned control unit 15 such that the volume of inert gas supplied by inert gas source 20 introduced into the ambient air of enclosed space 10 via the supply pipe system 17*a* and the outlet nozzle system 17*b* can be regulated accordingly.

Nitrogen is used, for example, as the inert gas in the embodiment, and has a gas density of 1.251 kg/m$^3$ under normal conditions.

The outlet nozzle system 17*b* of the depicted embodiment is configured to be controllable by control unit 15 such that a gas stratification including a first gas layer A, a second gas layer B and a transition layer C situated between the first and second gas layers A, B forms in the enclosed space 10 without structural separations. In this gas stratification, the oxygen content in the zone of the first gas layer A substantially corresponds to the oxygen content of the ambient atmosphere, whereby the oxygen content in the zone of the second gas layer B corresponds to a specific, definable oxygen content which is lower than the oxygen of the ambient atmosphere. The specific oxygen content in the zone of the second gas layer B is thereby set by the volume of inert gas introduced through the supply pipe system 17*a* and the outlet nozzle system 17*b* into the zone of the second gas layer B.

With the depicted embodiment, in order to achieve the most stable stratification in the ambient atmosphere of the space as possible, the nitrogen utilized as the inert gas is heated relative to the mean temperature of the ambient atmosphere of the space 10 prior to its introduction into the enclosed space 10, a consequence of this being that the specific density of the inert gas (nitrogen) is considerably lower than the specific density of the air within the enclosed space prior to the inert gas being introduced. Since the outlet nozzle system 17*b* is disposed in the upper section of the enclosed space 10 in the embodiment as depicted, when the preferably heated nitrogen is introduced into the enclosed space 10, the inert gas first floods the upper section of space 10 while normal ambient air still fills the lower section of the space.

By the inert gas supply being stopped prior to the entire volume of air in the space being flooded with inert gas, the previously-heated double-layered gas stratification can form in enclosed space 10, whereby the lower gas layer (first gas layer A) exhibits an oxygen content corresponding to the oxygen content of normal ambient air (21% by volume). On the other hand, by introducing the inert gas into the upper section of space 10, a zone (second gas layer B) is formed in which the oxygen content is reduced relative to the oxygen content of the normal ambient air, respectively, in comparison to the oxygen content of the first gas layer A.

Therefore, there is a continuous inertization in the zone of the second gas layer B; i.e., in the upper section of space 10, such that the inflammability of the goods stored in this zone is lowered. The oxygen content in the zone of the second gas layer B is thereby set to an inerting level corresponding to a specific oxygen content which is reduced relative to the oxygen content of the first gas layer A, whereby this inerting level can be accordingly specified by the appropriate amount of inert gas supplied into the zone of the second gas layer B.

In the present embodiment of the inventive inerting system, heated nitrogen is used as the inert gas. It would hereto be conceivable for the inert gas source 20 to be downstream a respective heating system 18 in order to warm the inert gas supplied through the supply pipe system 17*a* from the inert gas source 20. Alternatively or additionally hereto, it would however also be conceivable for the outlet nozzles 17*b* to be provided with the appropriate heating elements in order to correspondingly heat the inert gas as it is being discharged.

In order to maintain the formed gas layer over a longer period of time, the inerting system depicted as an example in FIG. 1 further includes a suction system 12, arranged in the transition layer C between the first gas layer A and the second gas layer B. This suction system 12 extracts gas from the transition layer C continuously or at specific times or events definable by the control unit 15, while fresh inert gas is simultaneously introduced into the zone of the second gas layer B through the outlet nozzle system 17*b*. This measure effectively suppresses a mixing of the two gas layers A, B.

In detail, the suction system 12 includes a suction nozzle system 12*a* and a fan 12*b* arranged in the transition layer C. The rotational speed and/or rotational direction of the fan 12*b* is controllable by means of control unit 15. A control valve V2, also controllable by means of the control unit 15, can be optionally arranged between the fan 12*b* and the suction nozzle system 12*a*. By appropriately regulating the rotational speed of the fan 12*b*, a sufficient amount of gas to maintain the gas stratification is extracted from transition layer C via the suction nozzle system and discharged to the outside. On the other hand, appropriately controlling fan 12*b* can also change its rotational direction so that the suction system 12 can also supply fresh air as needed to transition layer C.

By having preferably both the gas layers A, B formed in the enclosed space 10 at different temperatures, a particularly stable gas stratification is achieved. This difference in temperature can be maintained for a longer period of time by arranging the appropriate heating/cooling elements in enclosed space 10, in the respective zones of gas layers A, B respectively. These heating/cooling elements (not explicitly shown in FIG. 1) arranged in the respective zones of gas layers A, B are preferably controlled accordingly by means of the control unit 15.

In the depicted embodiment of the inerting system according to the invention, it is advantageously provided for the suction system 12 and specifically the suction nozzle system 12*a* to be designed so as to be vertically displaceable in order to be able to adjust the layer thickness to the zone of the second gas layer B and in conjunction hereto, also the layer thickness to the zone of the first gas layer A, as needed. It is clear that when the suction system 12 is arranged within the upper section of space 10, the zone of the second gas layer B will be correspondingly narrower than when the suction system 12 is situated in the lower section of space 10.

In the embodiment, the suction nozzle system 12*a* is arranged roughly in the middle of the enclosed space 10, which is an advantage inasmuch as the lower section of space 10 in which the first gas layer A is formed is not affected by the inert gas introduced so that unrestricted entering of the space 10 remains possible, for example through a door 9.

The preferred embodiment of the inerting system depicted is however not only suited to preventatively protecting against fire in the upper section of the space. Instead, it is also possible with the depicted embodiment to lower the ambient atmosphere to a base inertization level prior to the forming of the gas stratification by correspondingly lowering the oxygen content in the entire space 10 relative to the oxygen content of normal air, for example, by introducing an inert gas. After the two gas layers A, B have formed, the zone of the first gas layer A then has an oxygen content which is lower than the normal ambient air, whereby the zone of the second gas layer B has an even further reduced oxygen content.

In addition to the previously-cited inert gas source 20, it is in principle conceivable to provide a further inert gas system (not shown in FIG. 1) so as to continuously render the space inert prior to the gas stratification. The inert gas used for this purpose should however, exhibit a specific gas density which differs from the gas density of the inert gas used to form the gas stratification. Conceivable hereto would be using either different inert gases and/or inert gases at different temperatures.

Particularly preferred as an outlet nozzle system for the continuous inerting of the entire space is a nozzle system 17*b* which is designed to disperse the introduced inert gas as evenly as possible within the ambient atmosphere. Of course it would also be just as conceivable to provide for the applicable air circulation within space 10.

In addition, it is advantageous for the system to furthermore include at least one oxygen-measuring device 19 to measure the oxygen content in the ambient atmosphere of enclosed space 10. In the embodiment depicted in FIG. 1, an oxygen-measuring device 19 is provided both in the zone of the first gas layer A as well as in the zone of the second gas layer B. These oxygen-measuring devices 19 are preferably designed to work as aspirative systems.

In order to have the inerting system not only be suited as preventative protection against fire but also be suited as a measure to control fire, it is provided to measure for at least one respective fire characteristic in the zone of the first gas layer A and in the zone of the second gas layer B, either continuously or at predefined times or upon predefined events, whereby when at least one fire characteristic is detected, the oxygen content in the zone of the second gas layer B is lowered to a full inertization level, preferably by the sudden introduction of inert gas into the gas layer. It is of course also conceivable, however, to detect at least one fire characteristic in the zone of the first gas layer A and that in the event of a fire, also provide for the appropriate measures in the zone of the second gas layer B.

Specifically hereto, the system is additionally equipped with a fire detection system 16 to detect at least one fire characteristic in the ambient atmosphere of the enclosed space 10. The fire detection system 16 is preferably designed as an aspirative system which extracts representative air or gas samples from the atmosphere of both the first gas layer A on the one hand, as well as the atmosphere of the second gas layer B on the other, and feeds the same to a (not explicitly shown in FIG. 1) detector for at least one fire characteristic. The signals sent from the fire detection system 16 to the control unit 15 preferably continuously, or at preset times or upon predefined events, are used by the control unit 15—if necessary after a further processing or evaluation—to applicably control for example, regulating valve V1. Specifically, when the fire detection system 16 detects a fire in the enclosed space 10, the control unit 15 emits a corresponding signal thereto.

Figure 2:
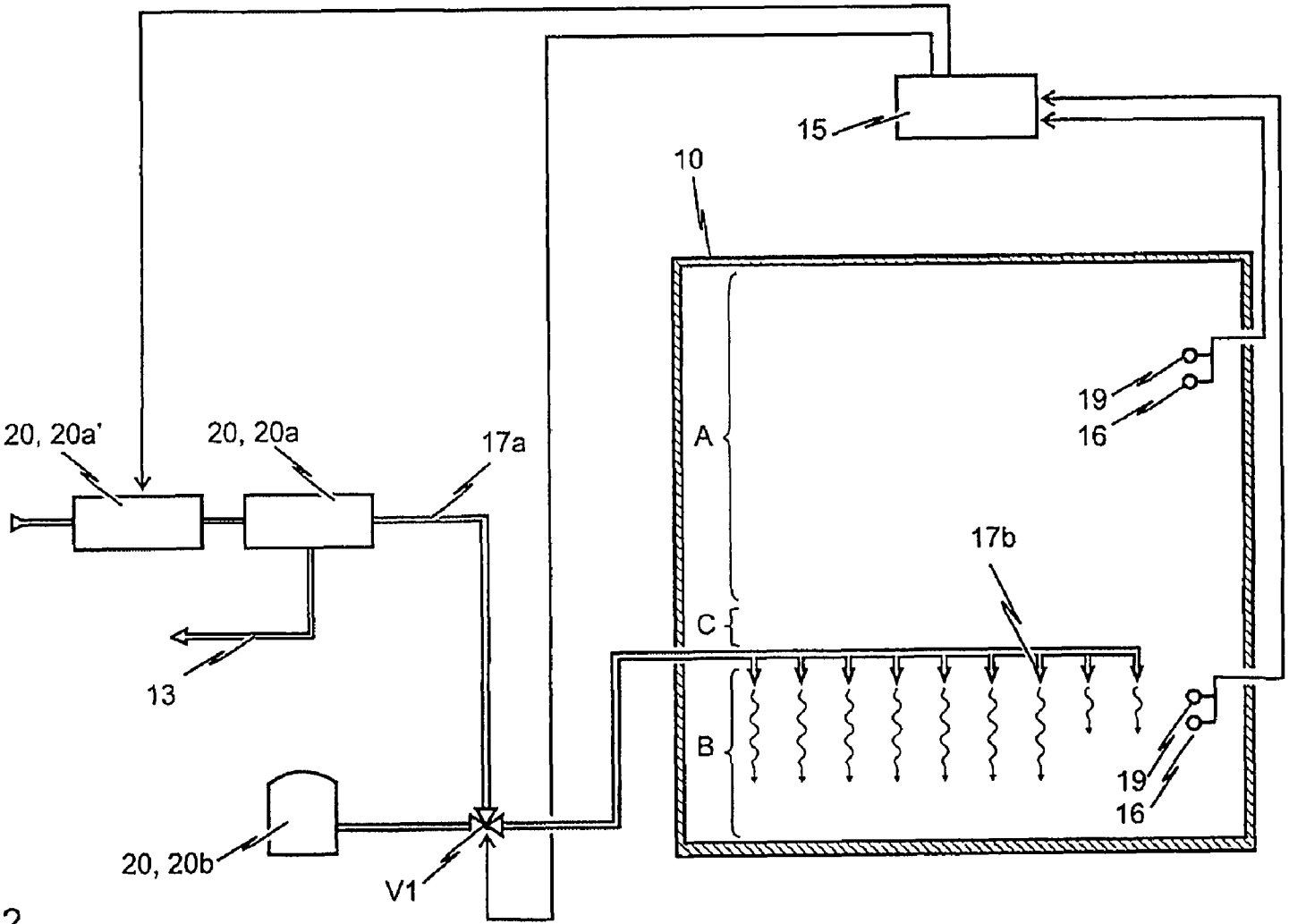
FIG. 2 is a second embodiment of the inerting system according to the invention.

FIG. 2 shows a second embodiment of the inerting system according to the invention. This embodiment firstly includes an inert gas generator 20*a* as inert gas source 20 which is connected to an ambient air compressor 20*a*'. As also in the first embodiment described with reference to FIG. 1, the control unit 15 accordingly regulates the air supply rate of the ambient air compressor 20*a*' so as to establish the rate of the inert gas supplied by the inert gas system 20*a*, 20*a*'.

Additionally to the inert gas system 20*a*, 20*a*', a gas cylinder battery, pressure tank 20*b* respectively, is provided in the system depicted in FIG. 2 in which liquefied $CO_2$ is stored as the inert gas. The gas cylinder battery 20*b*, which can of course also be configured as a liquid gas tank, is connected to the supply pipe system 17*a* by means of a 3-way valve V1 controllable by the control unit 15. The supply pipe system 17*a* supplies the inert gas produced by the inert gas system 20*a*, 20*a*' (nitrogen-enriched air) to the enclosed space 10. It is of course also conceivable for the gas cylinder battery 20*b* to be connected to the enclosed space 10 by means of a separate supply pipe system.

The embodiment depicted in FIG. 2 uses two different types of inert gas to form a gas stratification in enclosed space 10. Used as the first inert gas is nitrogen-enriched air produced by the inert gas system 20*a*, 20*a*'. This nitrogen-enriched air preferably serves to set a continuous inertization in the ambient atmosphere of enclosed space 10 at which the inflammability of most of the goods stored in space 10 is already reduced considerably. Applicable as this continuous inertization would for example be a base inertization level having an oxygen content of e.g. 15% by volume.

The base inertization level set in space 10, for example, for a sustained period, is monitored by means of the control unit 15 and the oxygen-measuring device 19 either on a continuous basis or at predefined times or upon predefined events. For example, if the oxygen content rises again in the ambient atmosphere of space 10 after the base inertization level has been set due to leakage through the spatial shell of enclosed space 10 or due to (intended or inadvertent) ventilation, the control unit 15 issues the corresponding control signal to the inert gas system 20*a*, 20*a*'. The inert gas system 20*a*, 20*a*' then feeds nitrogen-enriched air into the supply pipe system 17*a*. This nitrogen-enriched air fed to the supply pipe system 17*a* is thus, then introduced into space 10 by the appropriate control of the 3-way valve V1. This feeding of further nitrogen-enriched air will continue until the oxygen-measuring device 19 detects that the oxygen content of the ambient atmosphere has again sunk to the desired base inertization level.

A gas stratification of differing oxygen levels is established in the embodiment depicted in FIG. 2 by the $CO_2$ stored in the gas cylinder battery 20*b* being introduced preferably into the lower section of space 10. In the preferred embodiment, the $CO_2$ is introduced into space 10 after the previously-described introduction of nitrogen-enriched air already having set an inertization level (for example a base or a full inertization level).

The control unit 15 correspondingly controls the control valve V1 arranged in the supply pipe system 17*a* in order to form the gas stratification. Since (gaseous) $CO_2$ has a density of 1.977 kg/m$^3$ and thus, is considerably denser than for example, normal air and denser than nitrogen, and introducing $CO_2$ into the lower section of the enclosed space 10 results in the formation of a so-called "$CO_2$ lake"—i.e., a gas layer B—in the lower section of space 10 in which there is an increased concentration of $CO_2$, and thus, an oxygen concentration which is further reduced compared to the oxygen content of the upper section of the space (layer A). The $CO_2$ can be introduced into space 10 either in gaseous or liquid form.

A gas stratification is thus, formed in space 10 which includes a gas layer A formed in the upper section of space 10 and a gas layer B formed in the lower section of the space. The gas layer A formed in the upper section of space 10 has an oxygen content which substantially corresponds to the base inertization level set prior to the introduction of the $CO_2$ gas. The gas layer B formed in the lower section of space 10 contains the introduced $CO_2$ gas and thus, exhibits a further reduced oxygen content compared to gas layer A.

A transition layer C forms between the two gas layers A and B as a result of the given mixing. In the embodiment depicted in FIG. 2, this transition layer C should however be relatively narrow, since there is a relatively large difference between the mean density of the gas in layer A and the mean density of the gas in layer B and thus, the mixing is primarily only due to the diffusion flow of the gas particles.

It is clear that with the second preferred embodiment of the present invention described with reference to FIG. 2, particularly highly inflammable goods or goods which over time release highly inflammable substances as gas (e.g., hydrocarbons) are preferably to be stored in the lower gas layer B while goods of normal combustion behavior can be stored in the upper gas layer A.

The gas stratification should be regulated when a fire breaks out or threatens to break out in the ambient atmosphere of the enclosed space. Different fire detection systems 16 are preferably provided in the enclosed space 10 for this purpose.

The inventive solution is not limited to the use of nitrogen as the inert gas. Nor does the inert gas used need to be subjected to the corresponding temperature adjustment prior to its being introduced into the enclosed space.

Finally, the invention is not limited to the embodiments of the inerting system as depicted in the drawings. Instead, all the advantages and further developments as described in general and specified in the claims are to be considered integral to the invention.

The invention claimed is:

1. An inerting method for reducing a risk of fire outbreak in an enclosed space, wherein the method comprises:

introducing into the enclosed space at least one inert gas or an inert gas mixture having a different gas density ($\rho_{Gas}$) from a mean gas density ($\rho_{Gas}$) of an ambient atmosphere of the enclosed space such that a gas stratification comprised of a first gas layer (A), a second gas layer (B), and a transition layer (C) situated between said first and said second gas layer (A, B) forms in the enclosed space without any structural separation, wherein an oxygen content in the first gas layer (A) corresponds substantially to an oxygen content of the ambient atmosphere, wherein an oxygen content in the second gas layer (B) corresponds to a specific, definable oxygen content which is lower than the oxygen content of the ambient atmosphere, wherein a temperature of the first gas layer (A) and a temperature of the second gas layer (B) are measured, and wherein the gas stratification formed in the enclosed space is maintained by setting and maintaining a specific temperature difference between the temperature of the first gas layer (A) and the temperature of the second gas layer (B).

2. The method according to claim 1, wherein the gas stratification formed in the enclosed space is maintained by the regulated feeding of the inert gas, or the inert gas mixture respectively, into the second gas layer (B) and by the appropriate extracting of gas from the second gas layer (B) and/or from the transition layer (C).

3. The method according to claim 1, wherein the inert gas or inert gas mixture has a specific gas density ($\rho_{Gas}$) which differs from the specific gas density ($\rho_{Gas}$) of the ambient atmosphere at a same temperature.

4. The method according to claim 1, wherein when introducing the inert gas or inert gas mixture, said inert gas or inert gas mixture has a temperature which differs from a mean temperature of the ambient atmosphere.

5. The method according to claim 1, wherein the oxygen content in the second gas layer (B) is measured continuously or at predefined times or upon predefined events, and wherein the oxygen content in the second gas layer (B) is maintained at an inertization level corresponding to the defined oxygen content by the regulated feeding of inert gas or an inert gas mixture as well as the regulated extracting of gas from the second gas layer (B) and/or from the transition layer (C).

6. The method according to claim 1, wherein prior to the gas stratification being formed in the enclosed space, the ambient atmosphere of the enclosed space is changed by the introduction of an inert gas or an inert gas mixture such that the oxygen content in the ambient atmosphere is lowered to a specific base inertization level which corresponds to a lower oxygen content compared to the normal air oxygen content.

7. The method according to claim 6, wherein the oxygen content in the first gas layer (A) is measured continuously or at predefined times or upon predefined events, and wherein the oxygen content in the first gas layer (A) is maintained at the base inertization level by the regulated feeding of inert gas or an inert gas mixture into the first gas layer (A) as well as the regulated extracting of gas from the first gas layer (A) and/or from the transition layer (C).

8. The method according to claim 1, wherein at least one fire characteristic is measured in the second gas layer (B) continuously or at predefined times or upon predefined events, and wherein in an event a fire is detected, the oxygen content in the second gas layer (B) is lowered to a full inertization level, which corresponds to a further reduced oxygen content compared to the defined inertization level, by the sudden introduction of inert gas or an inert gas mixture into said second gas layer (B).

9. The method according to claim 1, wherein at least one fire characteristic is measured in the first gas layer (A) continuously or at predefined times or upon predefined events, and wherein in an event a fire is detected, the oxygen content in the first gas layer (A) is lowered to an inertization level which corresponds to a reduced oxygen content compared to the oxygen content of the ambient atmosphere by the sudden introduction of inert gas or an inert gas mixture into said first gas layer (A).

10. The method according to claim 1, wherein the first gas layer (A), the second gas layer (B), and the transition layer (C) each has a corresponding thickness and the respective layer thicknesses are adjustable.

11. An inerting method for reducing a risk of fire outbreak in an enclosed space, wherein the method comprises:

introducing into the enclosed space at least one inert gas or an inert gas mixture having a different gas density ($\rho_{Gas}$) from a mean gas density ($\rho_{Gas}$) of an ambient atmosphere of the enclosed space such that a gas stratification comprised of a first gas layer (A), a second gas layer (B), and a transition layer (C) situated between said first and said second gas layer (A, B) forms in the enclosed space without any structural separation, wherein an oxygen content in the first gas layer (A) corresponds substantially to an oxygen content of the ambient atmosphere, wherein an oxygen content in the second gas layer (B) corresponds to a specific, definable oxygen content which is lower than the oxygen content of the ambient atmosphere, and wherein the inert gas or inert gas mixture has a specific gas density ($\rho_{Gas}$) which differs from the specific gas density ($\rho_{Gas}$) of the ambient atmosphere at a same temperature.

12. The method according to claim 11, wherein the gas stratification formed in the enclosed space is maintained by regulated feeding of the inert gas, or the inert gas mixture respectively, into the second gas layer (B) and by appropriate extracting of gas from the second gas layer (B) and/or from the transition layer (C).

13. The method according to claim 11, wherein a temperature of the first gas layer (A) and the temperature of the second gas layer (B) are measured, and wherein the gas stratification formed in the enclosed space is maintained by setting and maintaining a specific temperature difference between the temperature of the first gas layer (A) and the temperature of the second gas layer (B).

14. The method according to claim 11, wherein when introducing the inert gas or inert gas mixture, said inert gas or inert gas mixture has a temperature which differs from a mean temperature of the ambient atmosphere.

15. The method according to claim 11, wherein the oxygen content in the second gas layer (B) is measured continuously or at predefined times or upon predefined events, and wherein the oxygen content in the second gas layer (B) is maintained at an inertization level corresponding to the defined oxygen content by the regulated feeding of inert gas or an inert gas mixture as well as the regulated extracting of gas from the second gas layer (B) and/or from the transition layer (C).

16. The method according to claim 11, wherein prior to the gas stratification being formed in the enclosed space, the ambient atmosphere of the enclosed space is changed by the introduction of an inert gas or an inert gas mixture such that the oxygen content in the ambient atmosphere is lowered to a specific base inertization level which corresponds to a lower oxygen content compared to the normal air oxygen content.

17. The method according to claim 16, wherein the oxygen content in the first gas layer (A) is measured continuously or at predefined times or upon predefined events, and wherein the oxygen content in the first gas layer (A) is maintained at the base inertization level by the regulated feeding of inert gas or an inert gas mixture into the first gas layer (A) as well as the regulated extracting of gas from the first gas layer (A) and/or from the transition layer (C).

18. The method according to claim 11, wherein at least one fire characteristic is measured in the second gas layer (B) continuously or at predefined times or upon predefined events, and wherein in an event a fire is detected, the oxygen content in the second gas layer (B) is lowered to a full inertization level, which corresponds to a further reduced oxygen content compared to the defined inertization level, by the sudden introduction of inert gas or an inert gas mixture into said second gas layer (B).

19. The method according to claim 11, wherein at least one fire characteristic is measured in the first gas layer (A) continuously or at predefined times or upon predefined events, and wherein in an event a fire is detected, the oxygen content in the first gas layer (A) is lowered to an inertization level which corresponds to a reduced oxygen content compared to the oxygen content of the ambient atmosphere by the sudden introduction of inert gas or an inert gas mixture into said first gas layer (A).

20. The method according to claim 11, wherein the first gas layer (A), the second gas layer (B), and the transition layer (C) each has a corresponding thickness and the respective layer thicknesses are adjustable.

21. An inerting method for reducing the risk of the outbreak of fire in an enclosed space, wherein the method comprises:

introducing into the enclosed space at least one inert gas or an inert gas mixture having a different gas density ($\rho_{Gas}$) from a mean gas density ($\rho_{Gas}$) of an ambient atmosphere of the enclosed space such that a gas stratification comprised of a first gas layer (A), a second gas layer (B), and a transition layer (C) situated between said first and said second gas layer (A, B) forms in the enclosed space without any structural separation, wherein an oxygen content in the first gas layer (A) corresponds substantially to an oxygen content of the ambient atmosphere, wherein an oxygen content in the second gas layer (B) corresponds to a specific, definable oxygen content which is lower than the oxygen content of the ambient atmosphere, and wherein when introducing the inert gas or inert gas mixture, said inert gas or inert gas mixture has a temperature which differs from a mean temperature of the ambient atmosphere.

22. The method according to claim 21, wherein the gas stratification formed in the enclosed space is maintained by the regulated feeding of the inert gas, or the inert gas mixture respectively, into the second gas layer (B) and by the appropriate extracting of gas from the second gas layer (B) and/or from the transition layer (C).

23. The method according to claim 21, wherein a temperature of the first gas layer (A) and the temperature of the second gas layer (B) are measured, and wherein the gas stratification formed in the enclosed space is maintained by setting and maintaining a specific temperature difference between the temperature of the first gas layer (A) and the temperature of the second gas layer (B).

24. The method according to claim 21, wherein the inert gas or inert gas mixture has a specific gas density ($\rho_{Gas}$) which differs from the specific gas density ($\rho_{Gas}$) of the ambient atmosphere at a same temperature.

25. The method according to claim 21, wherein the oxygen content in the second gas layer (B) is measured continuously or at predefined times or upon predefined events, and wherein the oxygen content in the second gas layer (B) is maintained at an inertization level corresponding to the defined oxygen content by the regulated feeding of inert gas or an inert gas mixture as well as the regulated extracting of gas from the second gas layer (B) and/or from the transition layer (C).

26. The method according to claim 21, wherein prior to the gas stratification being formed in the enclosed space, the ambient atmosphere of the enclosed space is changed by the introduction of an inert gas or an inert gas mixture such that the oxygen content in the ambient atmosphere is lowered to a specific base inertization level which corresponds to a lower oxygen content compared to the normal air oxygen content.

27. The method according to claim 26, wherein the oxygen content in the first gas layer (A) is measured continuously or at predefined times or upon predefined events, and wherein the oxygen content in the first gas layer (A) is maintained at the base inertization level by the regulated feeding of inert gas or an inert gas mixture into the first gas layer (A) as well as the regulated extracting of gas from the first gas layer (A) and/or from the transition layer (C).

28. The method according to claim 21, wherein at least one fire characteristic is measured in the second gas layer (B) continuously or at predefined times or upon predefined events, and wherein in an event a fire is detected, the oxygen content in the second gas layer (B) is lowered to a full inertization level, which corresponds to a further reduced oxygen content compared to the defined inertization level, by the sudden introduction of inert gas or an inert gas mixture into said second gas layer (B).

29. The method according to claim 21, wherein at least one fire characteristic is measured in the first gas layer (A) continuously or at predefined times or upon predefined events, and wherein in an event a fire is detected, the oxygen content in the first gas layer (A) is lowered to an inertization level which corresponds to a reduced oxygen content compared to the oxygen content of the ambient atmosphere by the sudden introduction of inert gas or an inert gas mixture into said first gas layer (A).

30. The method according to claim 21, wherein the first gas layer (A), the second gas layer (B), and the transition layer (C) each has a corresponding thickness and the respective layer thicknesses are adjustable.

31. An inerting method for reducing the risk of the outbreak of fire in an enclosed space, wherein the method comprises:

introducing into the enclosed space at least one inert gas or an inert gas mixture having a different gas density ($\rho_{Gas}$) from a mean gas density ($\rho_{Gas}$) of an ambient atmosphere of the enclosed space such that a gas stratification comprised of a first gas layer (A), a second gas layer (B), and a transition layer (C) situated between said first and said second gas layer (A, B) forms in the enclosed space without any structural separation, wherein an oxygen content in the first gas layer (A) corresponds substantially to an oxygen content of the ambient atmosphere, wherein an oxygen content in the second gas layer (B) corresponds to a specific, definable oxygen content which is lower than the oxygen content of the ambient atmosphere, and wherein the gas stratification formed in the enclosed space is maintained by regulated feeding of the inert gas, or the inert gas mixture respectively, into the second gas layer (B) and by the appropriate extracting of gas from the transition layer (C).

32. The method according to claim 31, wherein a temperature of the first gas layer (A) and a temperature of the second gas layer (B) are measured, and wherein the gas stratification formed in the enclosed space is maintained by setting and maintaining a specific temperature difference between the temperature of the first gas layer (A) and the temperature of the second gas layer (B).

33. The method according to claim 31, wherein the inert gas or inert gas mixture has a specific gas density ($\rho_{Gas}$) which differs from the specific gas density ($\rho_{Gas}$) of the ambient atmosphere at a same temperature.

34. The method according to claim 31, wherein when introducing the inert gas or inert gas mixture, said inert gas or inert gas mixture has a temperature which differs from a mean temperature of the ambient atmosphere.

35. The method according to claim 31, wherein the oxygen content in the second gas layer (B) is measured continuously or at predefined times or upon predefined events, and wherein the oxygen content in the second gas layer (B) is maintained at an inertization level corresponding to the defined oxygen content by the regulated feeding of inert gas or an inert gas mixture as well as the regulated extracting of gas from the second gas layer (B) and/or from the transition layer (C).

36. The method according to claim 31, wherein prior to the gas stratification being formed in the enclosed space, the ambient atmosphere of the enclosed space is changed by the introduction of an inert gas or an inert gas mixture such that the oxygen content in the ambient atmosphere is lowered to a specific base inertization level which corresponds to a lower oxygen content compared to the normal air oxygen content.

37. The method according to claim 36, wherein the oxygen content in the first gas layer (A) is measured continuously or at predefined times or upon predefined events, and wherein the oxygen content in the first gas layer (A) is maintained at the base inertization level by the regulated feeding of inert gas or an inert gas mixture into the first gas layer (A) as well as the regulated extracting of gas from the first gas layer (A) and/or from the transition layer (C).

38. The method according to claim 31, wherein at least one fire characteristic is measured in the second gas layer (B) continuously or at predefined times or upon predefined events, and wherein in an event a fire is detected, the oxygen content in the second gas layer (B) is lowered to a full inertization level, which corresponds to a further reduced oxygen content compared to the defined inertization level, by the sudden introduction of inert gas or an inert gas mixture into said second gas layer (B).

39. The method according to claim 31, wherein at least one fire characteristic is measured in the first gas layer (A) continuously or at predefined times or upon predefined events, and wherein in an event a fire is detected, the oxygen content in the first gas layer (A) is lowered to an inertization level which corresponds to a reduced oxygen content compared to the oxygen content of the ambient atmosphere by the sudden introduction of inert gas or an inert gas mixture into said first gas layer (A).

40. The method according to claim 31, wherein the first gas layer (A), the second gas layer (B), and the transition layer (C) each has a corresponding thickness and the respective layer thicknesses are adjustable.

41. A device for reducing a risk of a fire in an enclosed space comprising:

at least one inert gas source for supplying an inert gas or an inert gas mixture having a gas density ($\rho_{Gas}$) which differs from a mean gas density ($\rho_{Gas}$) of an ambient atmosphere of the enclosed space, and a supply and outlet nozzle system controllable by a control unit for introducing the inert gas or inert gas mixture supplied by the inert gas source into the enclosed space, wherein the supply and outlet nozzle system is designed such that a gas stratification consisting of a first gas layer (A), a second gas layer (B), and a transition layer (C) situated between said first and second gas layer (A, B), forms in the enclosed space without any structural separation, wherein the oxygen content in the first gas layer (A) corresponds substantially to an oxygen content of the ambient atmosphere and wherein the oxygen content in the second gas layer (B) corresponds to a specific, definable oxygen content which is lower than the oxygen content of the ambient atmosphere, and wherein the device further comprises a mechanism for regulating a temperature in the first gas layer (A) and/or a temperature in the second gas layer (B).

42. The device according to claim 41, wherein the outlet nozzle system comprises at least one vertically-displaceable outlet nozzle.

43. The device according to claim 41, further comprising a suction system controllable by a control unit in order to extract gas from the first gas layer (A) and/or the second gas layer (B) and/or the transition layer (C) in a regulated manner.

44. The device according to claim 43, wherein the suction system comprises at least one vertically-displaceable outlet nozzle.

* * * * *